US005293675A

United States Patent [19]

Shai

[11] Patent Number: 5,293,675

[45] Date of Patent: Mar. 15, 1994

[54] FASTENER FOR SHOELACES AND THE LIKE

[76] Inventor: Moti Shai, 6321 Nestle Ave., Reseda, Calif. 91355

[21] Appl. No.: 997,333

[22] Filed: Dec. 28, 1992

[51] Int. Cl.[5] ..... A43C 7/00

[52] U.S. Cl. ..... 24/712.1; 24/712.5; 24/712.9

[58] Field of Search ..... 24/712.5, 712.1, 712, 24/712.9, 713.6, 714.6, 115 M, 115 H, 129 A, 136 L, 128, 49 S

[56] References Cited

U.S. PATENT DOCUMENTS

| | | | |
|---|---|---|---|
| Re. 31,052 | 10/1982 | Adams | 24/712.5 |
| 551,356 | 12/1895 | Barker | 24/712.5 |
| 1,383,917 | 7/1921 | Eva | 24/712.9 |
| 1,531,410 | 3/1925 | Osterholt | 24/712.1 |
| 2,869,204 | 1/1959 | Mopps | 24/712.9 |
| 2,911,697 | 11/1959 | Henderson | 24/712.5 |
| 3,103,725 | 9/1963 | Robb et al. | 24/712.5 |
| 4,790,048 | 12/1988 | Arnt | 24/712.1 |

FOREIGN PATENT DOCUMENTS

| | | | |
|---|---|---|---|
| 0192804 | 11/1957 | Austria | 24/712.1 |
| 1286791 | 1/1962 | France | 24/712.1 |
| 0572449 | 1/1958 | Italy | 24/712.1 |
| 0202071 | 2/1966 | Sweden | 24/115 M |

*Primary Examiner*—Victor N. Sakran
*Attorney, Agent, or Firm*—Gilbert Kivenson

[57] ABSTRACT

A fastener for shoelaces and the like which is made up of a horizontal tube and a vertical tube. The lace ends are passed through the horizontal tube in opposite directions, then through slots in the walls of the vertical tube. The opposing laces are then formed into a bow, passed through the vertical tube and the ends knotted. Sliding of the tubes toward the shoe tightens the laces; upward motion of the tubes will then loosen the laces.

2 Claims, 1 Drawing Sheet

FASTENER FOR SHOELACES AND THE LIKE

BACKGROUND OF THE INVENTION AND PRIOR ART

The present invention relates to a fastener for shoelaces and the like, especially those used for children's shoes. Shoelaces tied in conventional bows are subject to loosening with the result that the shoe may become untied. This may cause a misstep or even a fall. Loosened shoe laces are also a nuisance while walking; frequent stops for retying become annoying for the wearer. The present invention is a simple, low cost device for securing the laces to keep the shoe tied tightly with provision of room for excess lace length without the need for tying a conventional bow.

The problem of maintaining shoelace tension has been recognized in the prior art. Adams (U.S. Pat. No. 31052) for example provides parallel disks into which the laces fit. A serrated plug is pushed into the space between the disks and bears on the laces to hold them under tension. Udelhofer (U.S. Pat. No. 4,665,590) teaches a flat body which holds two laces or cords. A toothed plate is forced into the body to prevent the laces from sliding with respect to one another. The holding plugs of these inventions can be lost and must be carefully stored when the shoes are removed. Herlau (U.S. Pat. No. 4,290,173) describes a pair of disks having teeth on their inner surfaces. When the laces are introduced, the teeth act on them to prevent back slipping. Boden (U.S. Pat. No. 3,845,575) employs a single disk to which a serrated lever is pivotably attached. A pair of laces is passed through the disk, tensioned and held in place by turning the lever so that the serrations engage the laces. Rob (U.S. Pat. No. 3,103,725) teaches a rectangular form perforated to accommodate two laces. The form is placed between tongue and vamp of the shoe and held in place by pressure of the wearer's foot. The excess lace lengths are then passed into a plate which is attached to the form by a sliding mechanism. Spring loaded, serrated devices are described by Rio (U.S. Pat. No. 2,200,895) and Gartmann (French 752,922).

All of the prior art employs relatively elaborate locking devices which are expensive to fabricate and in some cases difficult to use. The present invention is made up of only two, simple-to-produce parts, is readily applied to shoes and easily manipulated for tightening and loosening.

DESCRIPTION OF THE INVENTION

Figure 1:
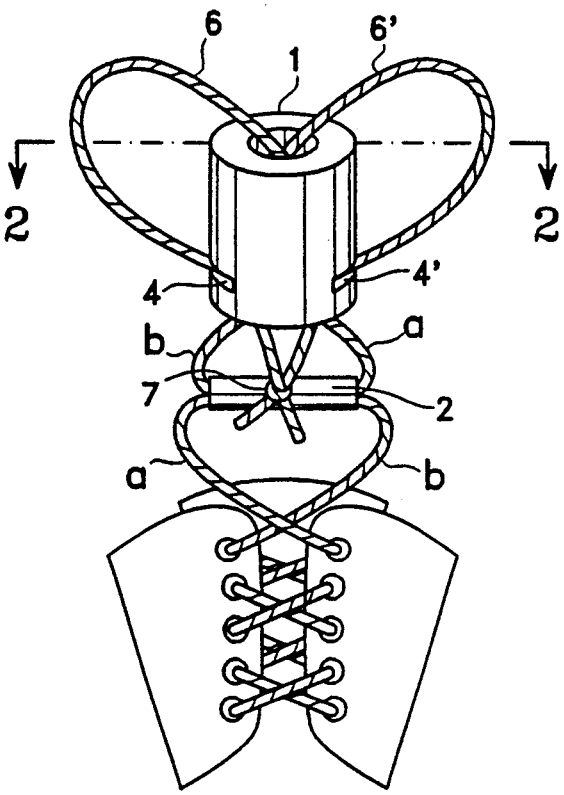
FIG. 1 is a perspective view of a first embodiment of the invention as it would be applied to a shoe.
Figure 2:
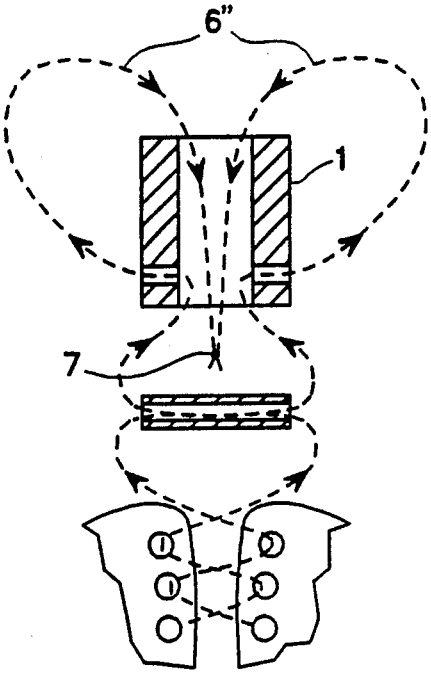
FIG. 2 is a partial cross sectional view taken along A—A' of FIG. 1.
Figure 3:
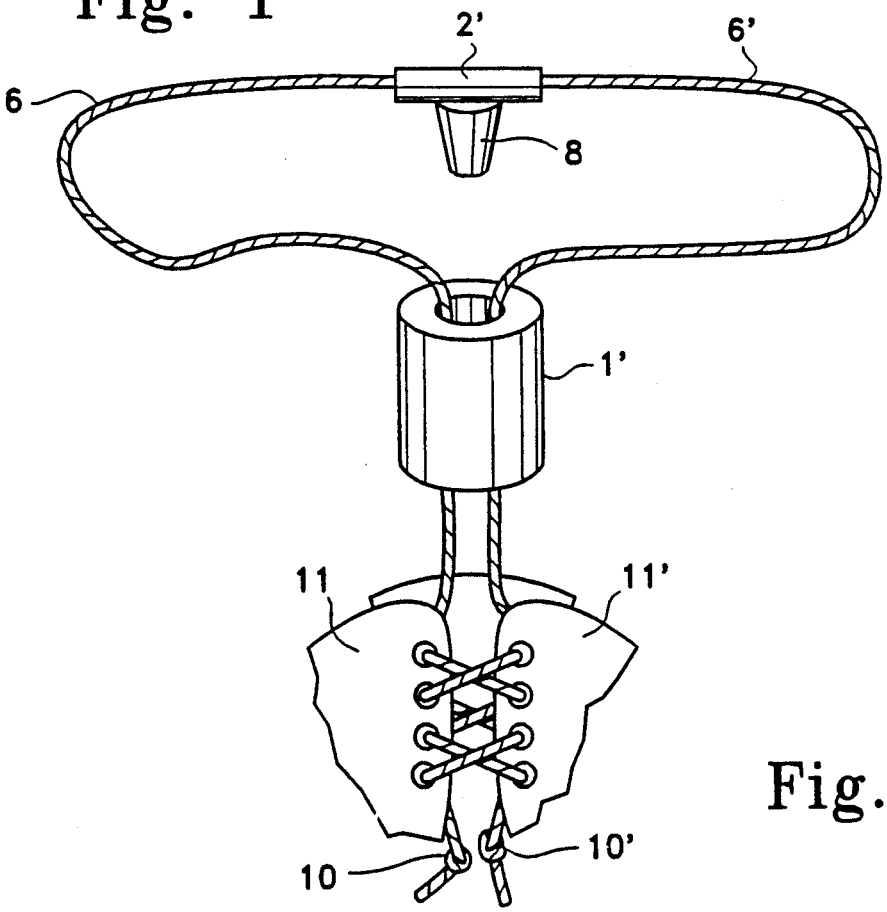
FIG. 3 is a perspective view of a second embodiment of the invention.

The first embodiment of the invention is made up of tubing sections 1 and 2 as shown in FIGS. 1 and 2. The horizontal tubing section 2 is smaller in diameter than vertical section 1. The latter is a heavy wall tube which slots 4 and 4' have been cut. The shoe laces a and b are first threaded through horizontal section 2 in opposite directions. Each lace is then pushed through slots 4 and 4' from the inside of section 1 and the ends brought to the top of the vertical section. The laces are then brought down through section 1 and knotted at 7. The loops 6 and 6' are then held in tension while horizontal section is pushed down to contact the vamps of the shoe. Finally, the vertical section 1 is pushed down to contact section 2. The loops 6 and 6' now form the bow 6''. The tie is held in place by frictional forces between the laces in sections 1 and 2 and in the slots 4 and 4' whenever an untying force is exerted. The laces are however easily loosened by holding the bow in tension and sliding sections 1 and 2 upward A second embodiment of the invention is shown in FIG. 3. Horizontal tube 2' now embodies the conical plug 8. In this case the lacing starts when the tube 2' centered in the middle of the lace. The ends are fed through the vertical tube, towards the shoes, down through the lacing holes in the vamps 11 and 11' and knotted at 10 and 10'. Tube 1 is then lowered with lace loops 6 and 6' held in tension. Finally plug 8 is pressed into the top of tube 1.

What is claimed is:

1. A fastener for the lacing of shoes and the like comprising:

a. a horizontal tube having an inside diameter to accommodate both laces with each lace being passed through said horizontal tube in opposing directions;

b. a vertical tube containing two slots in opposite walls; whereby the ends of the laces leaving the horizontal tube are introduced into the center of the vertical tube passed through corresponding slots, the lace ends formed into bows and then passed down through the vertical tube and finally knotted together.

2. A fastener for the lacing of shoes and the like as described in claim 1 in which said loops are held in upward tension while the horizontal tube and then the vertical tube is pushed down toward the shoe, this movement serving to tighten the laces and create a fastening force against accidental untying.

* * * * *